US011760543B2

(12) United States Patent
Parker, Jr. et al.

(10) Patent No.: US 11,760,543 B2
(45) Date of Patent: Sep. 19, 2023

(54) CLAMP RING FOR LID

(71) Applicant: Perimeter Solutions LP, St. Louis, MO (US)

(72) Inventors: Frank H. Parker, Jr., St. Louis, MO (US); Robert J. Dodson, Jr., St. Louis, MO (US); Stiles Jackson, St. Louis, MO (US); Adam Heimbuecher, St. Louis, MO (US); Mark Willmore, St. Louis, MO (US); Eric Linder, St. Louis, MO (US); Brett Klaas, St. Louis, MO (US); Brett Waters, St. Louis, MO (US)

(73) Assignee: Perimeter Solutions LP, St. Louis, MO (US)

( * ) Notice: Subject to any disclaimer, the term of this patent is extended or adjusted under 35 U.S.C. 154(b) by 37 days.

(21) Appl. No.: 17/128,106

(22) Filed: Dec. 19, 2020

(65) Prior Publication Data

US 2021/0188495 A1 Jun. 24, 2021

Related U.S. Application Data

(60) Provisional application No. 62/950,628, filed on Dec. 19, 2019.

(51) Int. Cl.
*B65D 45/34* (2006.01)

(52) U.S. Cl.
CPC ..... *B65D 45/345* (2013.01)

(58) Field of Classification Search
CPC .... B65D 45/345; B65D 45/32; B65D 45/322; B65D 45/325; B65D 45/327; B65D 45/34; B65D 45/00
USPC .... 220/321, 320, 319, 322; 292/256, 256.65
See application file for complete search history.

(56) References Cited

U.S. PATENT DOCUMENTS

| | | | | |
|---|---|---|---|---|
| 2,111,372 | A * | 3/1938 | Rollason | B65D 45/34 292/256.69 |
| 2,125,767 | A * | 8/1938 | Campbell | B65D 45/345 292/256.65 |
| 2,162,663 | A * | 6/1939 | Lockhart | B65D 45/345 292/256.65 |
| 2,236,649 | A * | 4/1941 | Proctor | B65D 45/345 24/456 |
| 5,322,177 | A | 6/1994 | Coggings | |
| 5,353,944 | A | 10/1994 | Davis et al. | |
| 10,472,169 | B1 | 11/2019 | Parker, Jr. et al. | |
| 2002/0030054 | A1 | 3/2002 | Boulange et al. | |
| 2018/0208394 | A1 | 7/2018 | Erren et al. | |

OTHER PUBLICATIONS

International Search Report and Written Opinion dated Feb. 1, 2022 relating to PCT Patent Application No. PCT/US2021/46003, 19 pages.

* cited by examiner

*Primary Examiner* — Robert Poon
(74) *Attorney, Agent, or Firm* — Harness, Dickey & Pierce, P.L.C.

(57) ABSTRACT

A claim ring for a lid, components thereof, and associated methods. The clamp ring is configured to maintain a lid on a mouth of a container to form a seal therebetween. The clamp ring includes a clamping mechanism including a wheel and a pull. The wheel is turnable to pull the pull to draw end portions of the clamping ring toward each other. A tool receiver can be engaged by a tool and turned by the tool to turn the wheel with the mechanical advantage of the tool.

20 Claims, 5 Drawing Sheets

CLAMP RING FOR LID

CROSS-REFERENCE TO RELATED APPLICATION

The present application claims priority to U.S. Provisional Patent App. No. 62/950,628, filed Dec. 19, 2019, which is hereby incorporated by reference in its entirety.

FIELD

The present disclosure generally relates to containers and more particularly for a clamp ring for retaining a lid on a container.

BACKGROUND

Various types of containers require a lid to be maintained over a mouth of the container. Clamp rings are sometimes used to hold lids in place on container mouths. The clamp rings are not user friendly and require significant force to install and remove. Improvements in clamp rings for lids are needed.

SUMMARY

In one aspect, a clamp ring for maintaining a lid on a mouth of a container comprises a collar including an arcuate collar body. The arcuate collar body includes opposite first and second end portions. The arcuate collar body defines an inner arcuate channel arranged to receive the lid and the mouth of the container. A clamping mechanism supported by the collar includes a pull and a wheel. The pull has a first segment connected to the first end portion of the arcuate collar body. The pull has a second segment engageable by the wheel and the wheel being turnable to pull the first segment of the pull toward the wheel to pull the first end portion of the arcuate collar body closer to the second end portion to change the collar from an unclamped configuration to a clamping configuration.

In another aspect, a method of installing a lid on a container comprises installing a clamp ring in an unclamped configuration on the container such that an arcuate channel of the clamp ring is located adjacent a mouth of the container and a lid on the mouth of the container. The method further comprises actuating a clamping mechanism of the clamp ring to draw end portions of the clamp ring toward each other to change the clamp ring from the unclamped configuration to a clamping configuration. The arcuate channel of the clamp ring in the clamping configuration receives the lid and the mouth in the arcuate channel and presses the lid against the mouth to form a seal therebetween. Actuating the clamping mechanism comprises turning a wheel to pull a pull to draw the end portions of the clamp ring toward each other.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
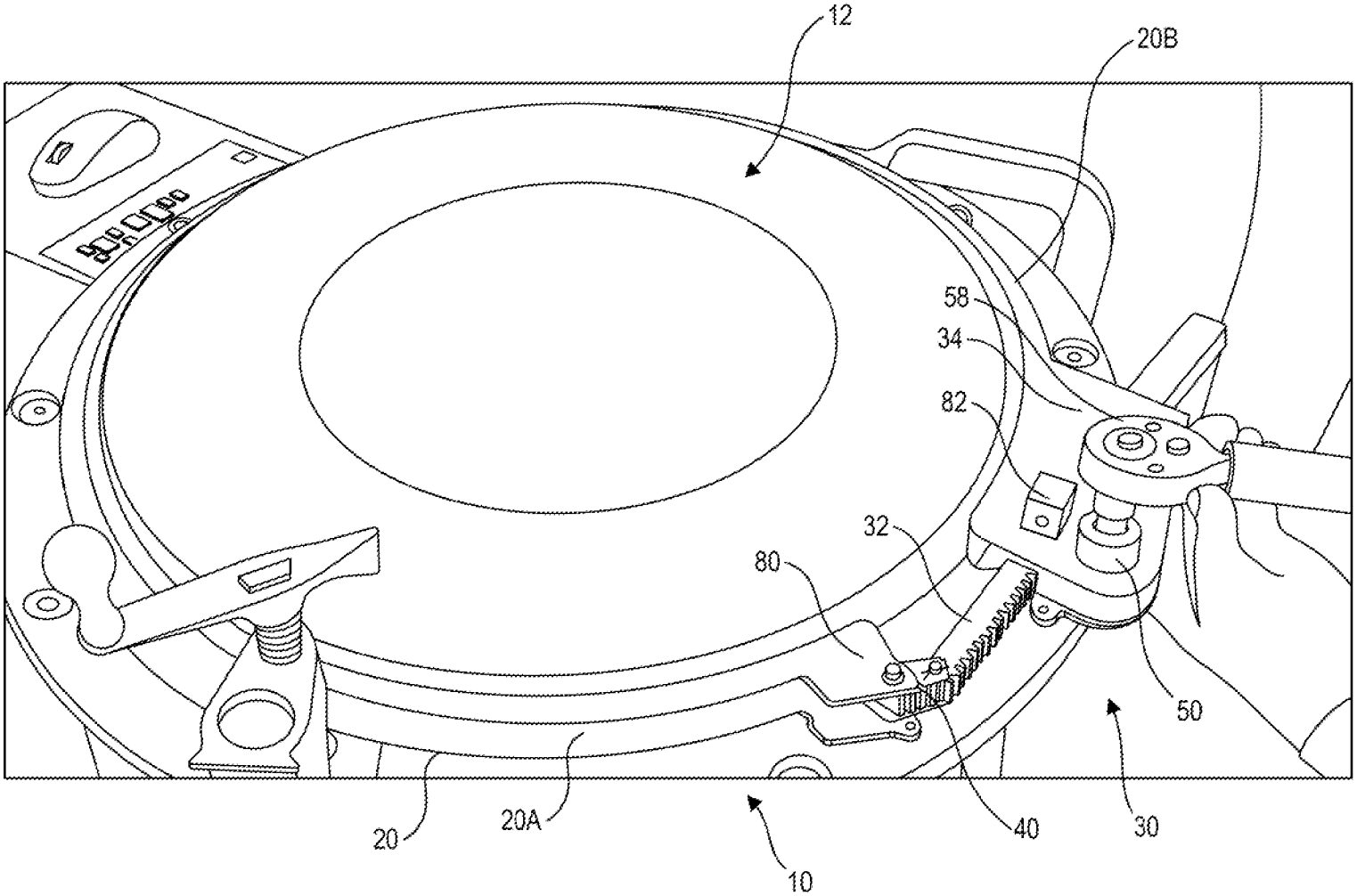
FIG. 1 is a top perspective of a container having a mouth covered by a lid with a clamp ring received over the lid and mouth, the clamp ring being shown in an unclamped configuration.

Referring to FIG. 1, a clamp ring of the present disclosure is indicated by 10. The clamp ring can be used for securing a lid 12 to a mouth of a container or other structure. In one embodiment, the clamp ring can be used to secure a lid to a mouth of a container holding phosphorous pentasulfide. The mouth of the container comprises a circular lip on which the lid is receivable. The lid 12 includes a cover portion and a circular flange extending downward from the cover. The flange extends around the mouth of the container. The lid 12 covers the mouth of the container. The lid forms a sealed connection with the mouth when the lid is covering the mouth of the container and the clamp ring 10 is clamped to press the lid against the lip of the mouth.

The clamp ring 10 includes a collar 20 sized and shaped to fit over the lid 12 and mouth of the container. The collar 20 includes a collar body defining an inner channel configured to capture the mouth of the container and the flange of the lid 12 to press the cover portion of the lid onto the lip of the mouth. The collar 20 is arcuate and includes a first end portion 20A and a second end portion 20B opposite the first end portion. In an unclamped configuration, the end portions 20A, 20B are spaced from each other, and the collar has a diameter greater than a diameter of the lid 12 and mouth such that the collar can be positioned over the lid and mouth.

Figure 5:
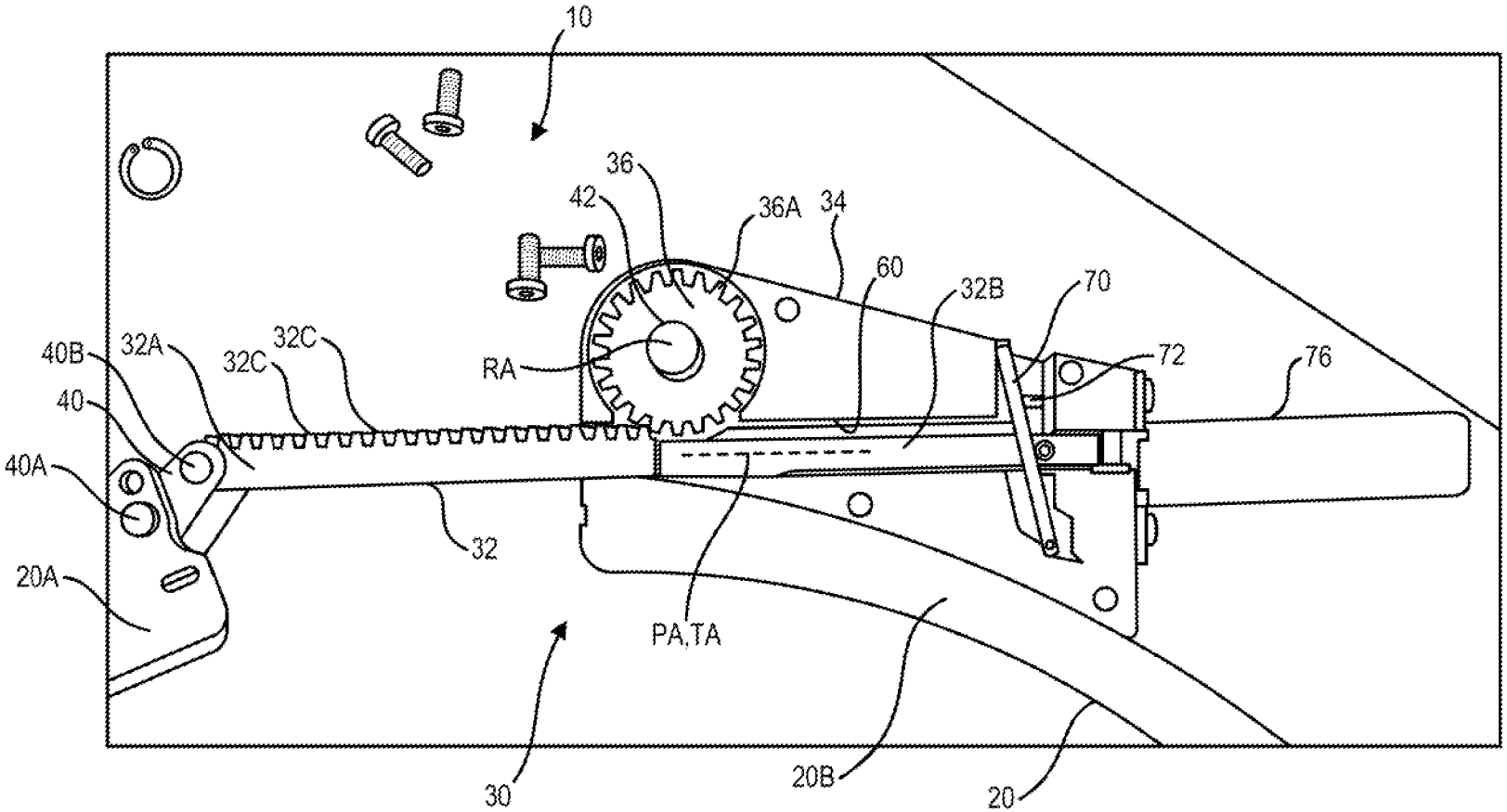
FIG. 5 is a bottom fragmentary view of the clamp ring having a housing portion removed to show a pinion and lock inside the housing.

The clamp ring 10 includes a clamping mechanism 30 configured to draw the end portions 20A, 20B of the clamp ring toward each other to configure the clamping ring in a clamping configuration to clamp the collar on the lid and mouth. The clamping mechanism 30 includes a pull 32, a housing 34, and a wheel 36 (FIG. 5). A wall of the housing 34 is removed in FIG. 5 to expose an interior of the housing and show internal components.

The pull 32 comprises a generally rigid bar and has a first segment 32A connected to the first end portion 20A of the collar 20 and has a second segment 32B opposite the first pull segment. The first segment 32A of the pull 32 is connected to the collar 20 by a linkage 40 (e.g., a chain link). The linkage 40 is pivotally connected by a first pin 40A to brackets on the first end segment 20A of the collar 20. The linkage 40 is pivotally connected to the first segment of the pull 32A by a second pin 40B.

The housing 34 is rigidly connected to the second end portion 20B of the collar 20. The wheel 36 is connected to the housing 34 by a pin 42 defining an axis of rotation RA about which the wheel rotates. The wheel 36 is configured to be rotated to pull the first collar portion 20A toward the second collar portion 20B by pulling the pull 32. In the illustrated embodiment, the pull 32 comprises a rack including a set of teeth 32C. The wheel 36 comprises a gear or pinion including teeth 36A configured to mesh with the teeth of the pull. The meshed teeth 32C, 36A cause the pull 32 to move in response to rotation of the wheel 36. The teeth 32C and/or 36A can be chamfered or tapered on their opposite sides to facilitate smooth operation and reduce likelihood of binding of the clamping mechanism.

Figure 2:
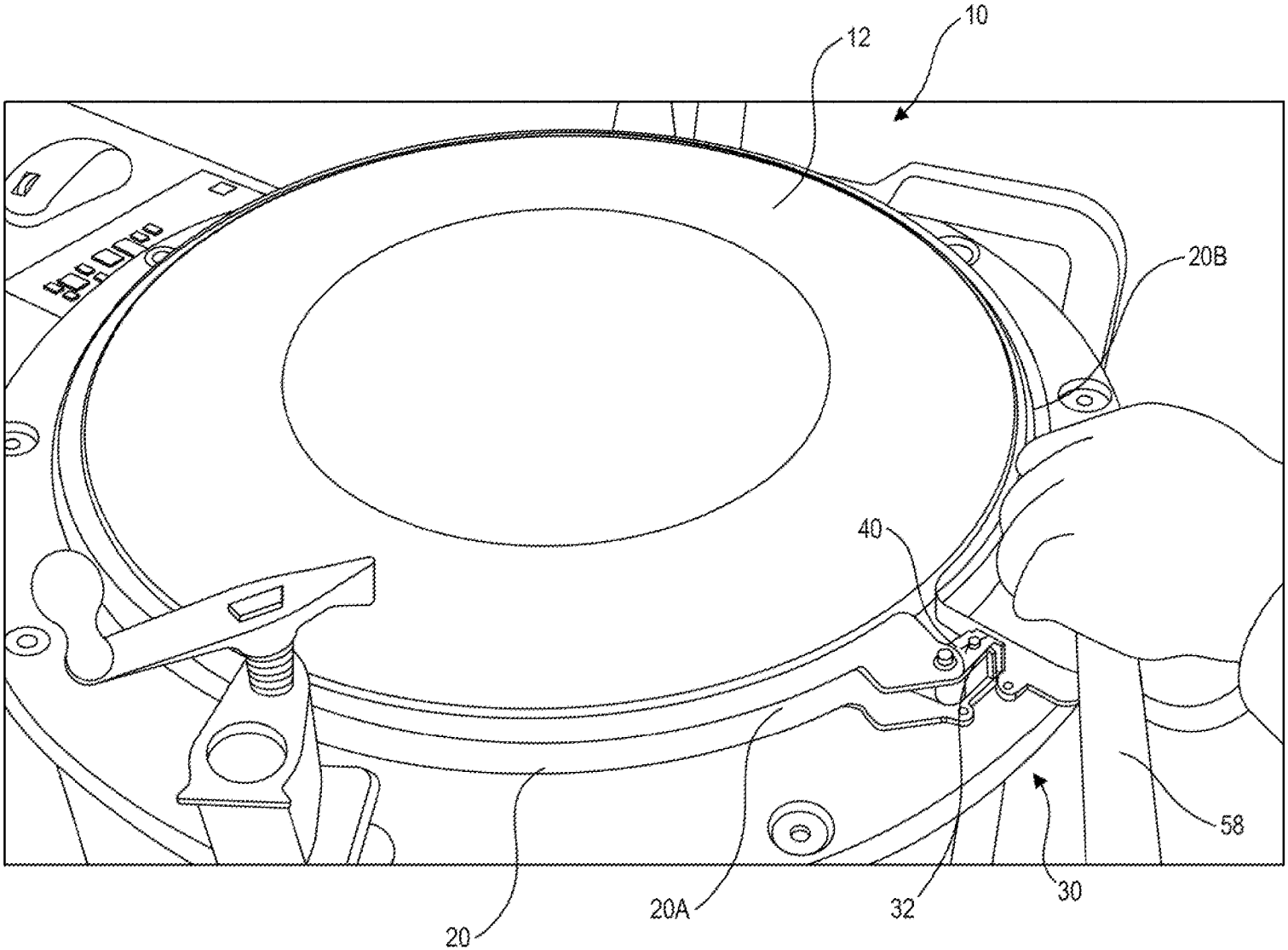
FIG. 2 is a view similar to FIG. 1 but showing the clamp ring in a clamped configuration.

The clamping mechanism 30 includes a hub 50 operatively connected to the wheel 36 for conjoint rotation with the wheel. The hub 50 defines a tool receiver for facilitating rotation of the hub and thus the wheel 36. In the illustrated embodiment, the tool receiver 50 comprises a socket sized and shaped to receive a head of a drive tool 58, and in particular a square head of a ratchet wrench or torque wrench. Other types of tool receivers can be used. As shown by comparison of FIGS. 1 and 2, rotation of the tool 58 and thus rotation of the hub 50 and wheel 36 causes the pull 32 to move into the housing 34 to pull the first end portion 20A of the collar 20 toward the second end portion 20B of the collar. It will be appreciated that the wheel may be turned less than 360 degrees to change from the unclamped configuration to the clamping configuration. Although a circular wheel 36 with teeth 36A around its entire circumference is shown, it will be appreciated that wheels having other shapes (e.g., partial circle or other shape) can be used.

Figure 3:
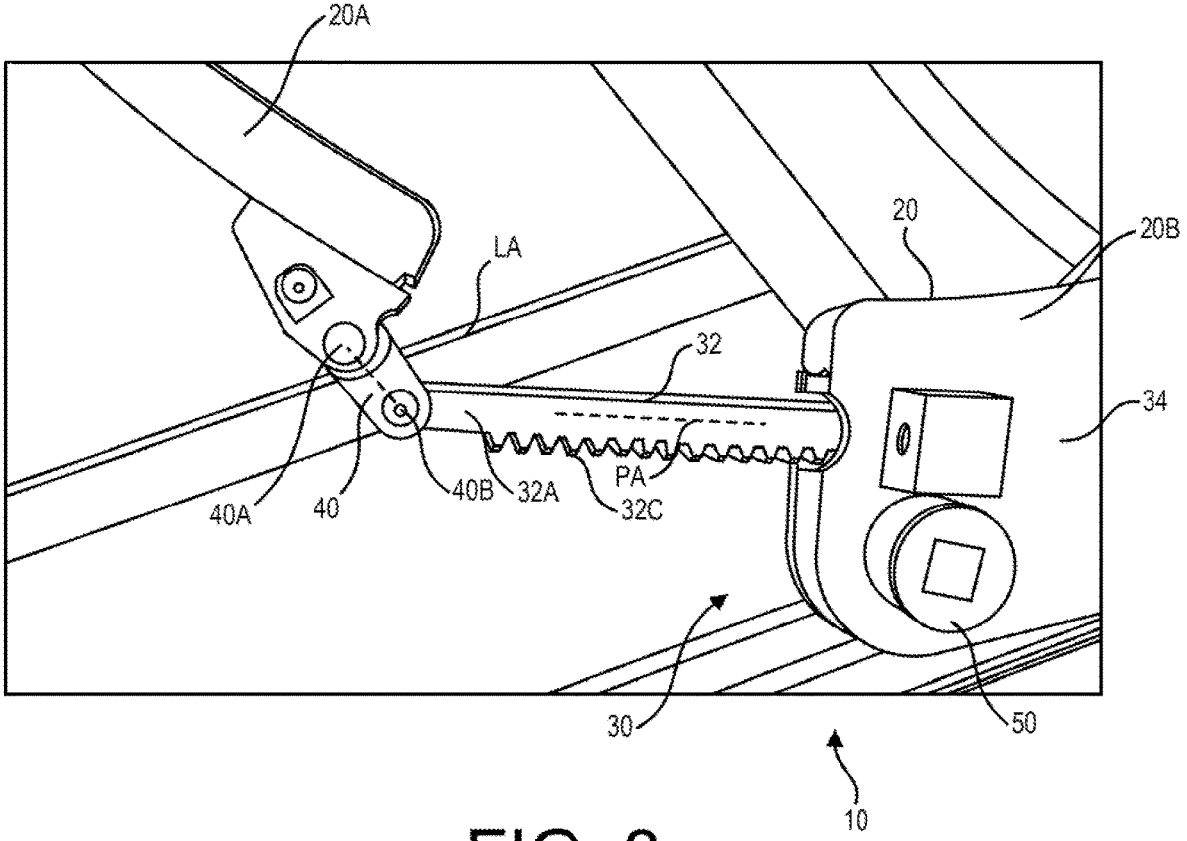
FIG. 3 is a fragmentary view of end portions of a collar of the clamp ring connected to each other by a clamping mechanism of the clamp ring.
Figure 4:
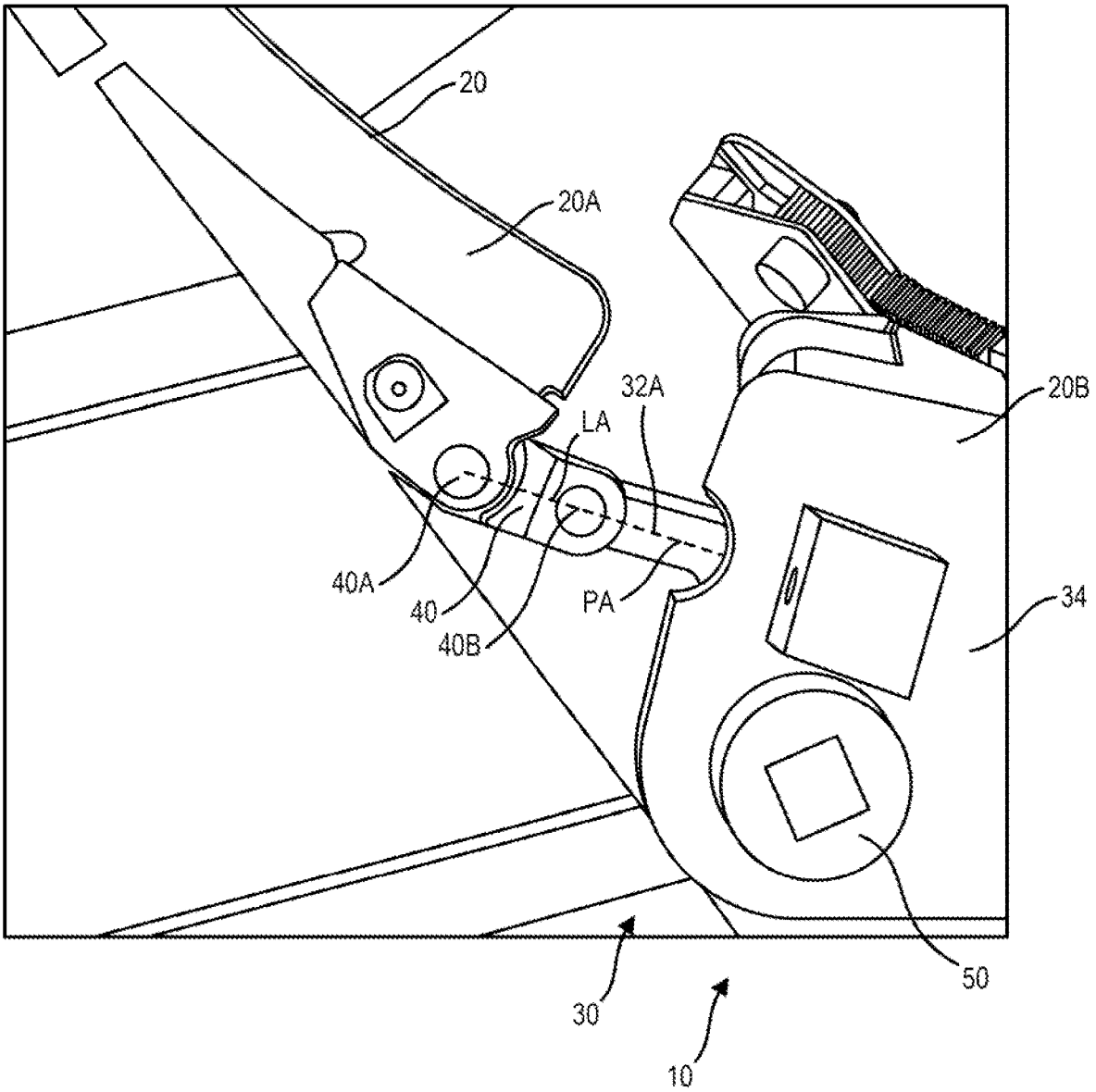
FIG. 4 is a view similar to FIG. 3 but showing a pull of the clamping mechanism moved into a housing of the clamping mechanism for changing the clamp ring to the clamped configuration.

Referring to FIG. 5, the housing 34 defines a track 60 (e.g., guide passage) that guides travel of the pull 32 in the housing. The track 60 guides the pull 32 in a generally linear travel path along a travel axis TA. The connection of the pull 32 to the first end portion 20A of the collar 20 by the linkage 40 and two pivot connections facilitates generally linear travel of the pull along the track 60 without bending or applying undue torque to the pull that might cause the clamping mechanism to bind. As shown in FIGS. 3 and 5, when the collar 20 is in the unclamped configuration, a linkage axis LA (extending between the pivot axes of the pins) is askew with respect to an axis PA of the pull. As shown by comparison of FIGS. 3 and 4, as the end portions 20A, 20B of the collar 20 are drawn toward each other, the linkage axis LA converges toward a generally codirectional orientation with respect to the pull axis PA and the travel axis TA.

The clamping mechanism 30 includes a lock 70 configured to maintain the collar 20 in the clamping configuration. In the illustrated embodiment, the lock 70 is configured to engage the pull 32 to limit movement of the pull out of the housing 34 to retain the collar in the clamping configuration. The lock 70 is configured to automatically lock the pull 32 as the pull advances in the housing 34. In the illustrated embodiment, the lock 70 comprises a toggle plate (broadly, "lock body") configured to engage the teeth 32C of the pull 32 in a ratcheting manner to successively lock the pull as the pull is advanced farther into the housing 34. The toggle plate 70 includes an opening through which the pull 32 extends. The toggle plate 70 is biased by a spring 72 toward a locking position (e.g., FIG. 5). The toggle plate 70 is temporarily deflectable against the bias of the spring 72 to an unlocking position to permit a tooth 32A of the pull 32 to pass through the opening in the toggle plate, after which the spring 72 moves the toggle plate back to the locking position to prevent the tooth from passing back through the toggle plate. The pull 32 lacks teeth on the second portion of the pull such that the toggle plate does not engage a tooth of the pull and thus does not begin locking the pull until the pull is advanced substantially into the housing 34. The housing 34 includes a cover 76 to receive the pull 32 as the pull advances into the housing.

In use, the lid 12 and collar 20 are positioned on the mouth of the container to be closed by the lid. A tool 58 is engaged with the tool receiver 50 and pivoted about the pivot axis PA to turn the wheel 36 and thus draw the pull 32 into the housing 34. About 180 degrees of pivoting of the tool 58 causes sufficient rotation of the wheel 36 to clamp the collar 20. The tool 58 is removed from the tool receiver 50 and the clamp ring 10 is left in the clamped configuration on the mouth. If desired, a safety tie or tamper lock (not shown) may be connected to brackets 80, 82 to ensure the collar 20 is not permitted to unclamp. When it is desired to remove the lid 12, the safety tie or tamper lock is removed (e.g., cut off). The tool 58 is engaged with the tool receiver 50 and rotated to tend to draw the pull 32 farther into the housing 34 such that the toggle plate 70 moves to the unlocking position. While the user holds the tool 58 in position, the user applies manual pressure to the toggle plate 70 (e.g., to an exposed end of the toggle plate or "release") to maintain the toggle plate in the unlocking position, at which time the user can permit the resilience of the collar 20 to move the end portions 20A, 20B of the collar 20 apart and thus pull the pull 32 out of the housing 34. The user can control release of the collar 20 by maintaining pressure on the tool but permitting slow and smooth unclamping of the collar.

It will be appreciated that the clamping collar 10 is configured to be easily clamped by application of minimal manual force amplified by mechanical advantage of the tool lever arm and meshed engagement of the wheel 36 with the pull 32.

In another aspect, the collar 20 extends in a plane across the mouth and the clamp ring 10 comprises a prop on an underside of the housing 34 extending transverse (downward) with respect to the plane. The prop is configured to engage the container to support and locate the collar 20 in a position to clamp the mouth when the collar is received over the mouth and the wheel 36 is rotated.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A clamp ring for maintaining a lid on a mouth of a container, the clamp ring comprising:

a collar including an arcuate collar body including opposite first and second end portions, the arcuate collar body defining an inner arcuate channel arranged to receive the lid and the mouth of the container; and a clamping mechanism supported by the collar, the clamping mechanism including a pull, a linkage, a track, and a wheel, the pull including a generally rigid bar having a segment connected to the first end portion of the arcuate collar body by the linkage, the rigid bar engageable by the wheel, the linkage pivotably connected to the segment of the rigid bar by a first pivot connection and to the first end portion of the arcuate collar body by a second pivot connection, the wheel being turnable to pull the segment of the rigid bar toward the wheel to pull the first end portion of the arcuate collar body closer to the second end portion to change the collar from an unclamped configuration to a clamping configuration, and the track configured to guide travel of the pull in a generally linear travel path along a travel axis as the wheel pulls the rigid bar, wherein the clamping mechanism is configured such that when the collar is in the unclamped configuration a linkage axis extending between pivot axes of the first and second pivot connections is askew with respect to a longitudinal axis of the pull, and when the collar is in the clamping configuration, the linkage axis is more codirectional with respect to the longitudinal axis of the pull and the travel axis than in the unclamped configuration.

2. A clamp ring as set forth in claim 1, further comprising a lock configured to maintain the collar in the clamping configuration.

3. A clamp ring as set forth in claim 2, wherein the lock is configured to engage the pull to limit movement of the pull away from the second end portion of the arcuate collar body to retain the collar in the clamping configuration.

4. A clamp ring as set forth in claim 3, wherein the lock is configured to automatically lock the pull as the pull advances responsive to turning of the wheel.

5. A clamp ring as set forth in claim 4, wherein the lock comprises a lock body configured to engage the pull in a ratcheting manner to successively lock the pull as the pull is advanced responsive to turning of the wheel.

6. A clamp ring as set forth in claim 5, wherein the pull comprises a set of teeth, and the lock body is arranged to engage the set of teeth to lock the pull.

7. A clamp ring as set forth in claim 1, wherein the pull comprises a rack including a set of teeth, and the wheel comprises a pinion including teeth configured to mesh with the teeth of the pull.

8. A clamp ring as set forth in claim 7, wherein the teeth of the rack are chamfered on sides of the teeth extending along a length of the rack.

9. A clamp ring as set forth in claim 1, further comprising a hub operatively connected to the wheel to cause rotation of the wheel, the hub defining a tool receiver adapted to receive a tool to facilitate rotation of the hub and thus rotation of the wheel.

10. A clamp ring as set forth in claim 1, further comprising:

a lock configured to maintain the collar in the clamping configuration; and a hub operatively connected to the wheel to cause rotation of the wheel, the hub defining a tool receiver adapted to receive a tool to facilitate rotation of the hub and thus rotation of the wheel wherein the pull comprises a rack including a set of teeth, and the wheel comprises a pinion including teeth configured to mesh with the teeth of the pull.

11. A clamp ring as set forth in claim 2, wherein the lock comprises a lock body defining an opening through which the pull extends.

12. A clamp ring as set forth in claim 11, wherein the lock comprises a spring configured to bias the lock body in a locking position.

13. A clamp ring as set forth in claim 12, wherein the lock body is configured to temporarily deflect against the bias of the spring to an unlocking position to permit the pull to pass through the opening of the lock body.

14. A method of maintaining a lid on a container with a clamp ring, the claim ring including a collar and a clamping mechanism supported by the collar, the collar including opposite first and second end portions, the clamping mechanism including a pull, a linkage, a track, and a wheel, the pull including a generally rigid bar engageable by the wheel and having a segment connected to the first end portion of the collar by the linkage, the linkage pivotably connected to the segment of the rigid bar by a first pivot connection and to the first end portion of the collar by a second pivot connection, the method comprising:

installing the clamp ring in an unclamped configuration on the container such that an arcuate channel of the clamp ring is located adjacent a mouth of the container and the lid on the mouth of the container;

actuating the clamping mechanism of the clamp ring to draw the first and second end portions of the collar toward each other to change the clamp ring from the unclamped configuration to a clamping configuration, the arcuate channel of the clamp ring in the clamping configuration receiving the lid and the mouth in the arcuate channel and pressing the lid against the mouth to form a seal therebetween, wherein actuating the clamping mechanism comprises turning a wheel to pull the segment of the rigid bar to draw the first and second end portions of the collar toward each other;

guiding, with the track, travel of the pull in a generally linear travel path along a travel axis as the wheel pulls the rigid bar; and pivoting, as the wheel pulls the rigid bar, the linkage about the first and second pivot connections, wherein when the clamp ring is in the unclamped configuration a linkage axis extending between pivot axes of the first and second pivot connections is askew with respect to a longitudinal axis of the pull, and when the clamp ring is in the clamping configuration, the linkage axis is more codirectional with respect to the longitudinal axis of the pull and the travel axis than in the unclamped configuration.

15. A method as set forth in claim 14, wherein rotating the wheel causes teeth of the wheel meshed with teeth of the pull to pull the segment of the rigid bar to draw the first and second end portions of the collar toward each other.

16. A method as set forth in claim 14, further comprising engaging a tool receiver with a head of a tool, and turning the head of the tool to turn the tool receiver to cause the wheel to turn and pull the segment of the rigid bar to draw the first and second end portions of the collar toward each other.

17. A method as set forth in claim 14, further comprising engaging the pull with a lock to retain the clamp ring in the clamping configuration.

18. A method as set forth in claim 17, wherein engaging the pull with the lock includes engaging the pull with the lock in a ratcheting manner.

19. A method as set forth in claim 17, wherein the lock comprises a lock body defining an opening through which the pull extends and wherein the method further comprises biasing the lock body with a spring to retain the clamp ring in the clamping configuration.

20. A method as set forth in claim 19, further comprising temporarily deflecting against the bias of the spring to permit the pull to pass through the opening of the lock body.

* * * * *